US010285525B2

(12) United States Patent
Dry et al.

(10) Patent No.: US 10,285,525 B2
(45) Date of Patent: May 14, 2019

(54) MAILBOX, AND MOUNTING ASSEMBLY AND MOUNTING METHOD THEREFOR

(71) Applicant: SOLAR GROUP, INC., Taylorsville, MS (US)

(72) Inventors: J. Derrick Dry, Laurel, MS (US); Jeremy D'Len Dickens, Laurel, MS (US)

(73) Assignee: SOLAR GROUP, INC., Taylorsville, MS (US)

( * ) Notice: Subject to any disclaimer, the term of this patent is extended or adjusted under 35 U.S.C. 154(b) by 228 days.

(21) Appl. No.: 15/270,257

(22) Filed: Sep. 20, 2016

(65) Prior Publication Data

US 2018/0078069 A1 Mar. 22, 2018

(51) Int. Cl.
*A47G 29/12* (2006.01)

(52) U.S. Cl.
CPC ..... *A47G 29/1216* (2013.01)

(58) Field of Classification Search
CPC ..... A47G 29/1216; E04H 12/22; E04H 12/2253; E04H 12/2269
USPC ..... 232/39; 248/146, 150, 159, 220.21
See application file for complete search history.

(56) References Cited

U.S. PATENT DOCUMENTS

| | | | | |
|---|---|---|---|---|
| 3,244,128 A * | 4/1966 | Rogalski | A47B 3/12 108/158.11 |
| 5,362,019 A * | 11/1994 | Swanson | A47G 29/1216 232/39 |
| 7,275,680 B1 * | 10/2007 | Pins | A47G 29/1216 232/39 |
| 2008/0149791 A1 * | 6/2008 | Bradley | E04H 12/2253 248/220.21 |
| 2011/0068235 A1 * | 3/2011 | Patterson | A47G 29/1216 248/125.1 |
| 2013/0061499 A1 * | 3/2013 | Berglund | G09F 1/00 40/607.1 |

* cited by examiner

*Primary Examiner* — William L Miller
(74) *Attorney, Agent, or Firm* — Eckert Seamans

(57) ABSTRACT

A mounting assembly is for a mailbox. The mailbox has an enclosure member. The mounting assembly includes a sleeve member, a first support member coupled to the sleeve member and the enclosure member, a second support member coupled to the sleeve member, and a pad member coupled to the second support member. The mounting assembly has an axis extending through an opening in each of the sleeve member, the first support member, the second support member, and the pad member.

20 Claims, 8 Drawing Sheets

MAILBOX, AND MOUNTING ASSEMBLY AND MOUNTING METHOD THEREFOR

BACKGROUND

Field

The disclosed concept relates to mailboxes. The disclosed concept also relates to mounting assemblies for mailboxes. The disclosed concept further relates to methods of mounting mailboxes.

Background Information

Mailboxes typically include an enclosure member for containing parcels of mail, and one of a number of different types of support structures for supporting the enclosure member. One known support structure is a post member that is fixed in the ground at one end and coupled to the enclosure member at an opposing end. Another known support structure includes a concrete pad fixed to the ground, and a mounting assembly that extends between the concrete pad and the enclosure member.

There is room for improvement in mailboxes, and in mounting assemblies and mounting methods therefor.

SUMMARY

These needs and others are met by embodiments of the disclosed concept, which are directed to a novel mailbox, and mounting assembly and mounting method therefor.

In accordance with one aspect of the disclosed concept, a mounting assembly for a mailbox is provided. The mailbox has an enclosure member. The mounting assembly includes a sleeve member, a first support member coupled to the sleeve member and the enclosure member, a second support member coupled to the sleeve member, and a pad member coupled to the second support member. The mounting assembly has an axis extending through an opening in each of the sleeve member, the first support member, the second support member, and the pad member.

In accordance with another aspect of the disclosed concept, a mailbox including the aforementioned mounting assembly is provided.

In accordance with another aspect of the disclosed concept, a method of mounting a mailbox includes the steps of providing the aforementioned mounting assembly; and selecting one of a) mounting the mounting assembly over a post member; and b) mounting the mounting assembly on a concrete pad.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "coupled" together shall mean that the parts are joined together either directly or joined through one or more intermediate parts.

As employed herein, the statement that two parts are "connected" together shall mean that the parts are joined together directly.

As employed herein, the term "coupling member" refers to any suitable connecting or tightening mechanism expressly including, but not limited to, rivets, screws, bolts and the combinations of bolts and nuts (e.g., without limitation, lock nuts), washers and nuts, zip ties, and wire ties.

Figure 1:
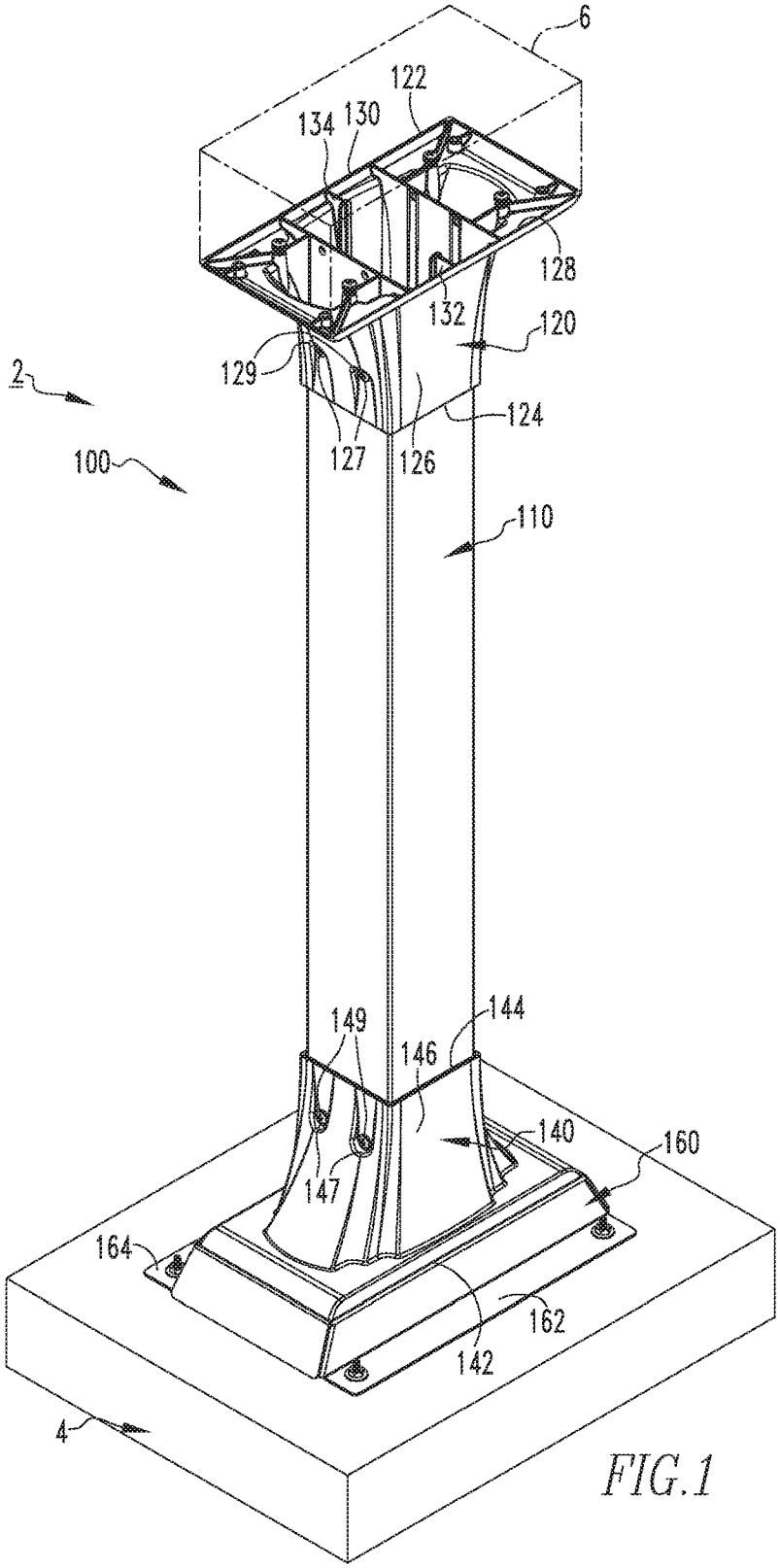
FIG. 1 is an isometric view of a mailbox and mounting assembly therefor, in accordance with a non-limiting embodiment of the disclosed concept, with the enclosure member shown in simplified form in phantom line drawing.

FIG. 1 shows a mailbox 2, in accordance with a non-limiting embodiment of the disclose concept. The example mailbox 2 is shown optionally mounted on a concrete pad 4 (shown in simplified form), and includes an enclosure member 6 (shown in simplified form in phantom line drawing), and a novel mounting assembly 100 extending between the concrete pad 4 and the enclosure member 6. As will be discussed in greater detail below, the mounting assembly 100 provides several significant benefits over known mounting assemblies (not shown). For example and without limitation, the mounting assembly 100 is able to be mounted to a post member (see, for example, post member 204 in FIGS. 7-9) in addition to the concrete pad 4 based upon the individual desires or requirements of the installer. Furthermore, the mounting assembly 100 allows the enclosure member 6 to be maintained at, or suitably adjusted among a number of elevations or heights with respect to the ground.

Continuing to refer to FIG. 1, the mounting assembly 100 includes a sleeve member 110, a first support member 120 coupled to the sleeve member 110 and the enclosure member 6, a second support member 140 coupled to the sleeve member 110, and a pad member 160 coupled to the second support member 140. The sleeve member 110, the support members 120,140, and the pad member 160 may be made of any suitable material known in the art (e.g., without limitation, steel and/or aluminum). In the example of FIG. 1, the pad member 160 has spaced apart generally coplanar planar portions 162, 164 that are each flush with and coupled to the concrete pad 4. This provides a relatively stable structure on which the weight of the mounting assembly 100 can be supported.

Figure 2:
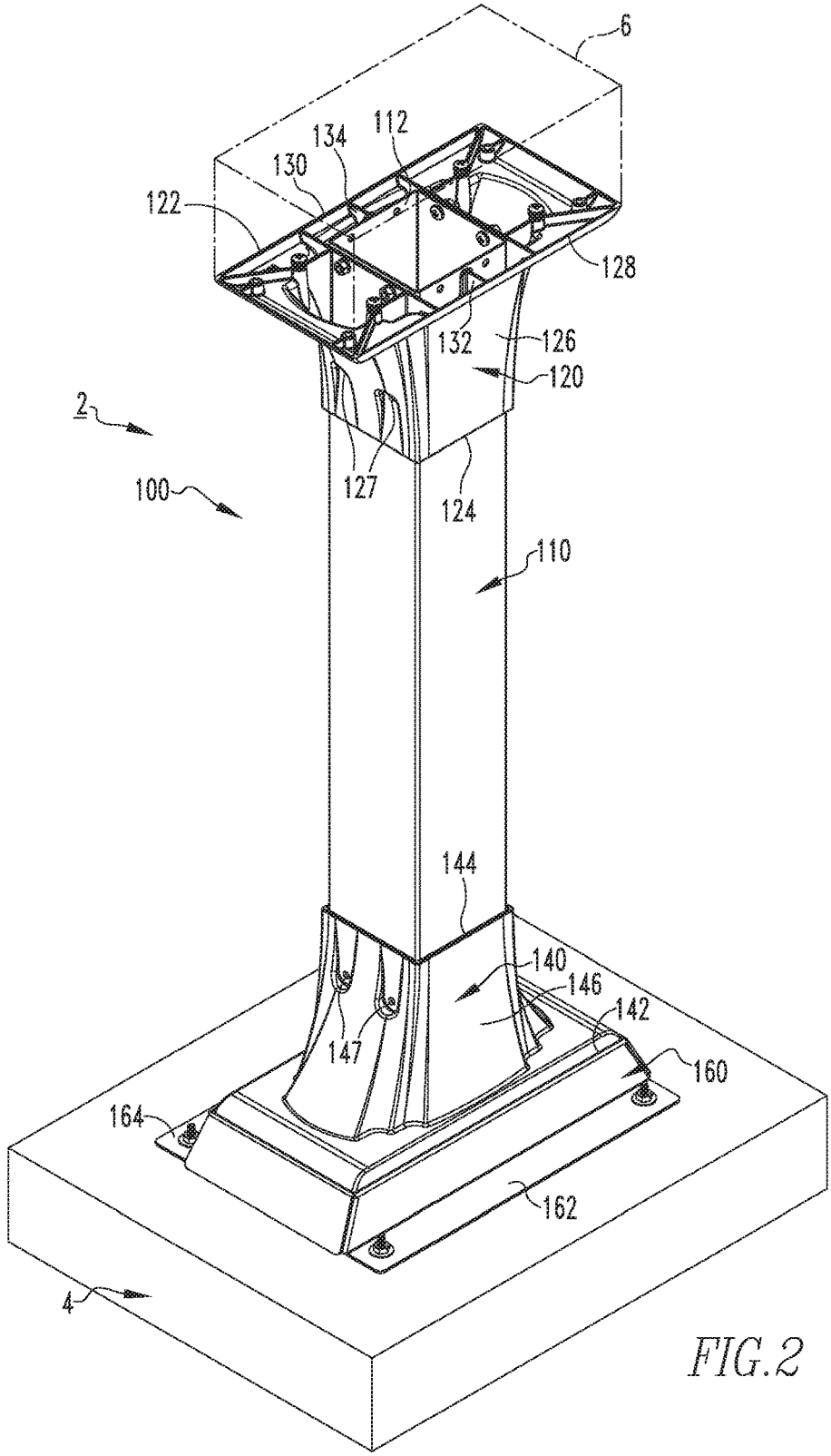
FIG. 2 is another isometric view of the mailbox and mounting assembly therefor of FIG. 1, modified to show components of the mounting assembly at different elevations with respect to each other as compared to FIG. 1.

As mentioned, the enclosure member 6 is advantageously able to be mounted at different elevations with respect to the ground. FIG. 2 shows the mailbox 2 with certain components at different elevations with respect to each other, as compared to FIG. 1. More specifically, in order to vary the elevation, the sleeve member 110 is able to be coupled to different locations on the support members 120, 140. In this manner, while the second support member 140 is fixed with respect to the pad member 160, the sleeve member 110 and the first support member 120 are able to have different elevations or heights with respect to the pad member 160. The support members 120, 140 include respective first end portions 122, 142, respective second end portions 124, 144 opposite and distal the first end portions 122, 142, and respective middle portions 126, 146 extending between the end portions 122, 124, 142, 144. The sleeve member 110 includes a first end portion 112 (see, for example, FIG. 4) and a second end portion 114 (FIG. 4) opposite and distal the first end portion 112. In order to adjust the elevation of components of the mailbox 2, the end portions 112, 114 may be coupled to any number of different locations at or between the respective end portions 122, 124, 142, 144.

For example and without limitation, as seen in the example of FIG. 2, the end portion 112 is coupled to the end portion 122 of the support member 120. That is, the end portion 112 and the end portion 122 are located proximate one another, and in the example of FIG. 2 engage and are coupled to one another. Although not seen, it will be appreciated that the end portion 114 (FIG. 4) is coupled to the end portion 142 in a similar manner. Thus, in the example of FIG. 2 the first support member 120 and the sleeve member 110 have first elevations with respect to the pad member 160 corresponding to the end portions 112, 114 being coupled to the respective end portions 122, 142. It will also be appreciated that a middle portion of the sleeve member 110 can be coupled to the end portion 142 such that the end portion 114 is located proximate the planar portions 162, 164 of the pad member 160. However, as seen in FIG. 2, the respective middle portions 126, 146 of the support members 120, 140 each have a number of thru holes 127, 147. It will be appreciated that in the example of FIG. 1, the end portions 112, 114 (FIG. 4) are not coupled to the respective end portions 122, 142, but rather are coupled to the middle portions 126, 146.

That is, in the example of FIG. 1, the mounting assembly 100 includes a respective number of coupling members 129, 149 that extend through the thru holes 127, 147 in order to couple the respective end portions 112, 114 (FIG. 4) to the middle portions 126, 146. Thus, the first support member 120 and the sleeve member 110 have second elevations with respect to the pad member 160 corresponding to the end portions 112, 114 (FIG. 4) being coupled to the respective middle portions 126,146. It will also be appreciated that by drilling additional thru holes in the sleeve member 110, the end portions 112 (FIG. 4) can be located at an infinite number of other locations at or between the end portion 122 and the thru holes 127, and the end portion 114 (FIG. 4) can also be located at an infinite number of other locations at or between the thru holes 147 and the planar portions 162, 164. Accordingly, by being able to be mounted at different elevations with respect to the ground, the mailbox 2 is advantageously able to accommodate desired conditions and/or regulations with respect to height requirements (e.g., without limitation, height requirements of the United States Postal Service and/or desired heights of different homeowners).

Figure 3:
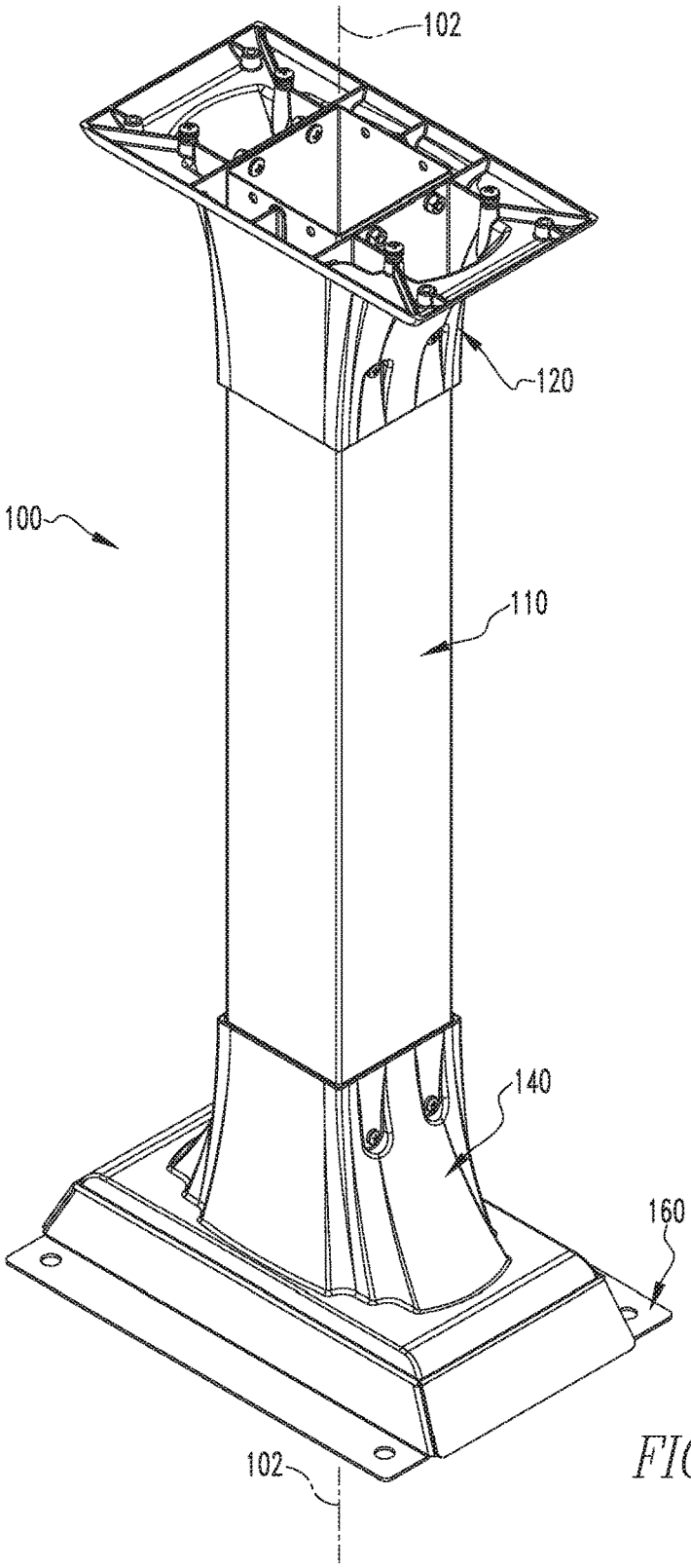
FIG. 3 is an isometric view of the mounting assembly of FIG. 2.
Figure 4:
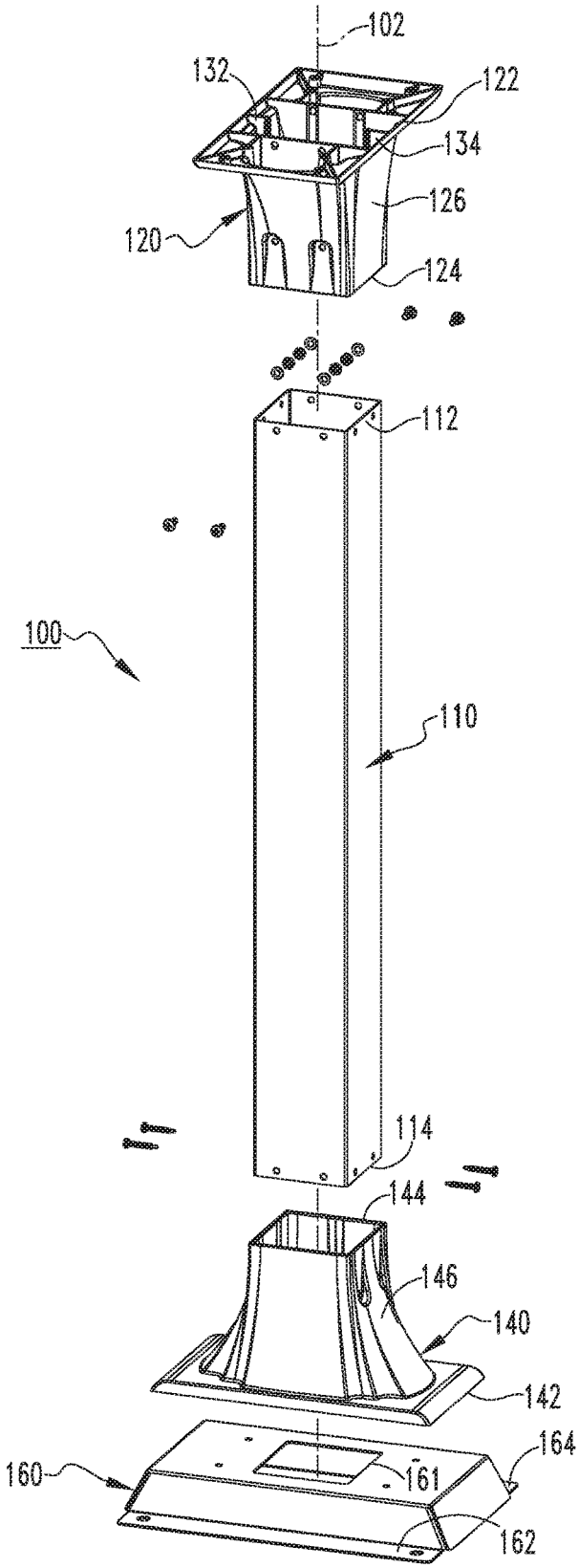
FIG. 4 is an exploded isometric view of the mounting assembly of FIG. 3, shown with one of the support members rotated 90 degrees with respect to the orientation of FIG. 3.

FIGS. 3 and 4 show different views of the mounting assembly 100. As seen, the mounting assembly 100 has an axis 102 extending through an opening in the sleeve member 110, the first support member 120, the second support member 140, and the pad member 160. As will be discussed in connection with FIGS. 7-9, the instant attribute advantageously allows the mounting assembly 100 to receive and accommodate a post member (i.e., the post member 204 in the example of FIGS. 7-9), distinct from known prior art mounting assemblies (not shown) in which either sealed portions (e.g., components devoid of thru holes) or obstructions within components prevent the mounting assembly from receiving post members.

Figure 5:
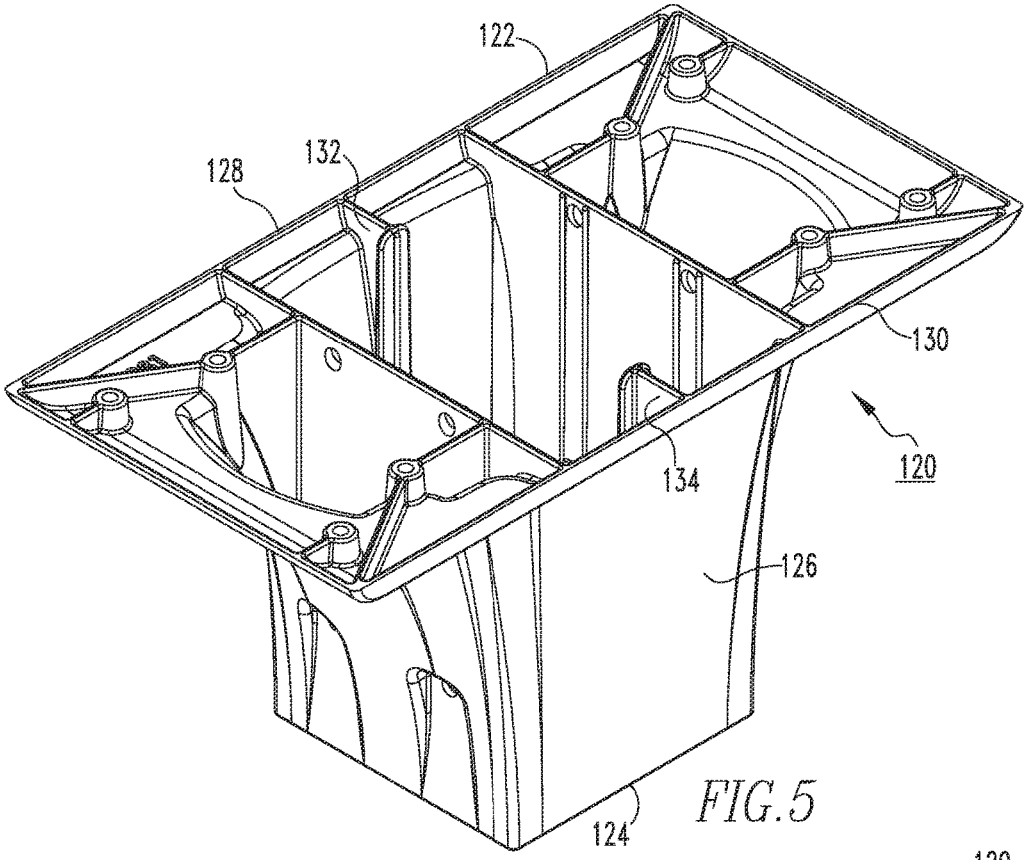
FIG. 5 and FIG. 6 are isometric and bottom plan views, respectively, of a support member for the mounting assembly of FIG. 4.

Referring to FIG. 5, the first support member 120 includes a body having a first side portion 128, a second side portion 130 opposite the first side portion 128, a first guide rail portion 132 extending from the first side portion 128 toward the second side portion 130, and a second guide rail portion 134 extending from the second side portion 130 toward the first side portion 128. The guide rail portions 132, 134 provide a novel mechanism for the first support member 120 to receive the sleeve member 110 (FIG. 4). Specifically, the guide rail portions 132, 134 project inwardly from the respective side portions 128, 130. As a result, during assembly the sleeve member 110 (FIG. 4) can be easily inserted between the guide rail portions 132, 134. This advantageously aides with maintaining the vertical position of the support member 120. In one example, the sleeve member 110 (FIG. 4) engages each of the guide rail portions 132, 134. Furthermore, the example guide rail portions 132, 134 disclosed herein are parallel to one another and are parallel to the sleeve member 110 (FIG. 4).

It will also be appreciated that in one example embodiment the second support member 140 is shaped the same (i.e., has the same footprint or geometry) as the first support member 120. Thus, the second support member 140 may also have guide rail portions (not shown) shaped the same and configured with respect to the sleeve member 110 the same as the first support member 120. In such an embodiment, manufacturing is advantageously simplified in that tooling (not shown) is only required to manufacture one support member (i.e., a support member having the footprint of both the support members 120, 140).

Figure 6:
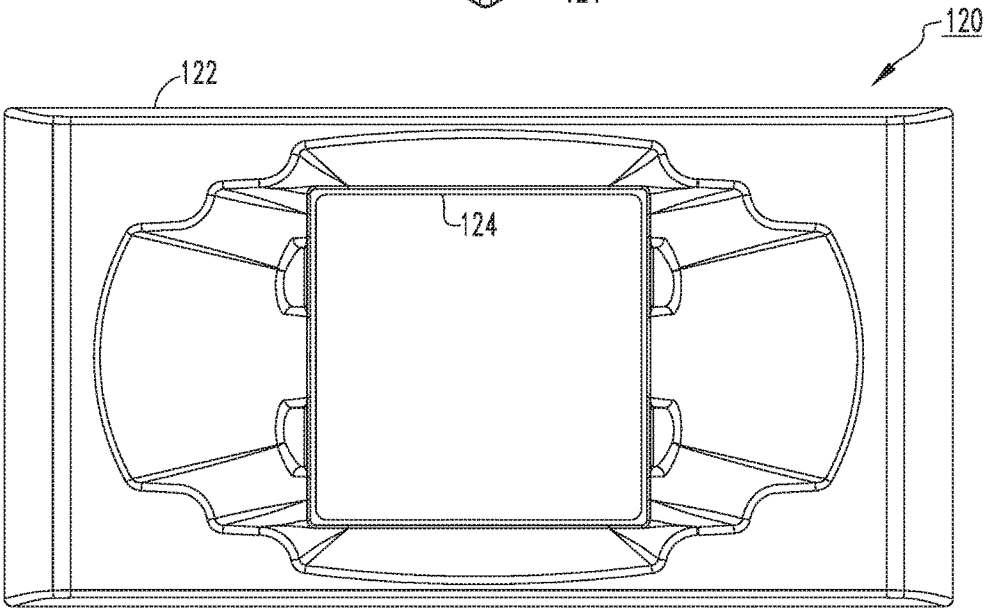

As seen in the bottom plan view of FIG. 6, the first end portion 122 has a first rectangular-shaped perimeter having a first length, and the second end portion 124 has a second rectangular-shaped perimeter having a second length less than the first length. In this manner, the support member 120 is advantageously able to be well maintained on the sleeve member 110 (FIG. 4), and is also able to provide suitable support for the enclosure member 6. Accordingly, the weight of the enclosure member 6 (FIG. 1) is distributed over a relatively large surface area proximate the first end portion 122. Additionally, with respect to the second support member 140 (FIGS. 1-4), the instant geometry advantageously distributes the weight of the enclosure member 6 (FIG. 1), the first support member 120, and the sleeve member 110 (FIG. 4) over a relatively large surface area (i.e., see, for example, the engagement between the second support member 140 and the pad member 160).

Figure 7:
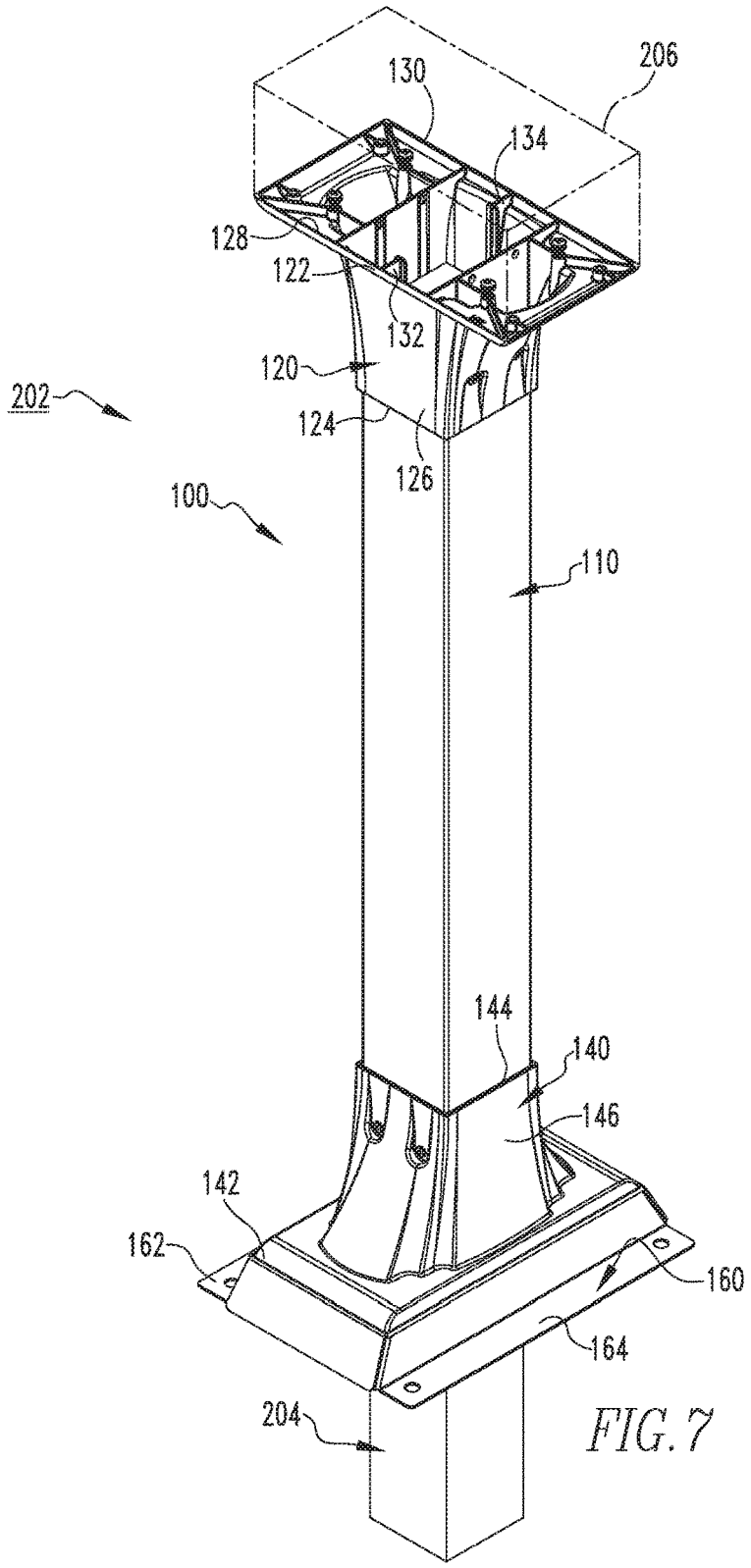
FIG. 7 is an isometric view of another mailbox and mounting assembly therefor, in accordance with another non-limiting optional mounting embodiment of the disclosed concept.
Figure 8:
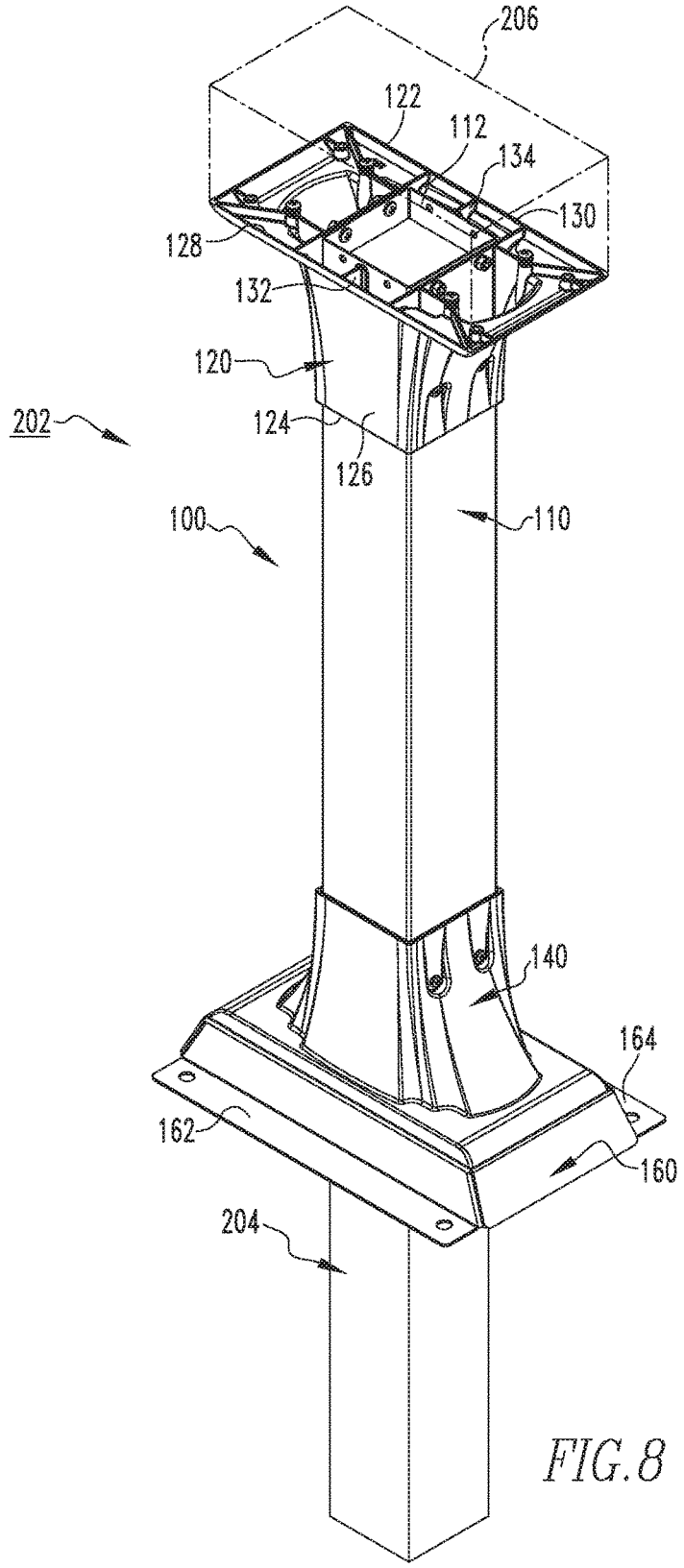
FIG. 8 is another isometric view of the mailbox and mounting assembly therefor of FIG. 7, shown in a different position and with components of the mounting assembly at different elevations with respect to each other as compared to FIG. 8.
Figure 9:
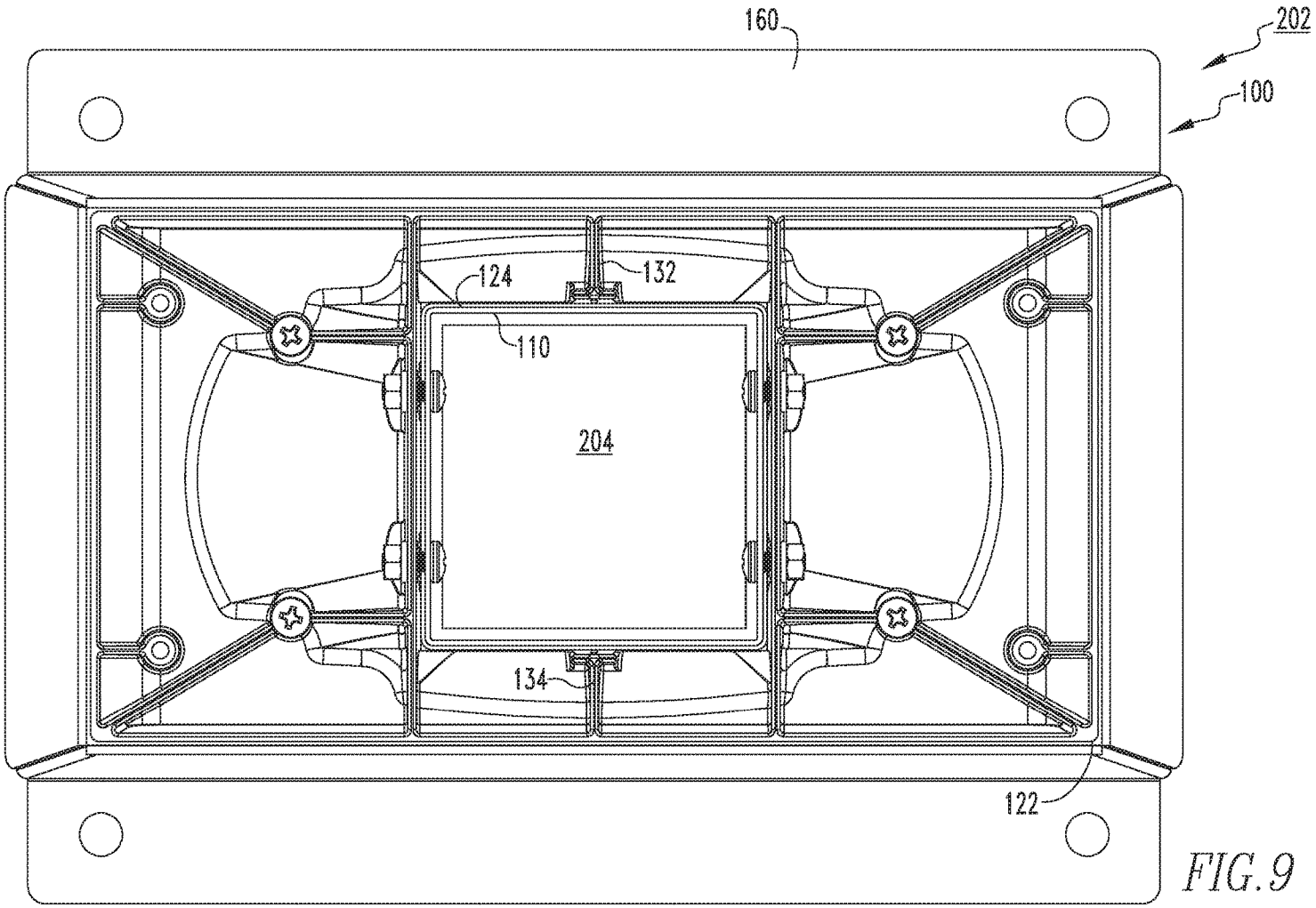
FIG. 9 is a top plan view of the mailbox and mounting assembly therefor of FIG. 8.

FIGS. 7-9 show another mailbox 202, in accordance with another non-limiting embodiment of the disclosed concept. The example mailbox 202 includes the mounting assembly 100, discussed above, an enclosure member 206, and is shown optionally mounted on a post member 204. The post member 204 may be, for example and without limitation, a suitable four-by-four wooden post member. Accordingly, it will be appreciated that the sleeve member 110, the first support member 120, the second support member 140, and the pad member 160 each have thru holes through which the post member 204 is able to extend. That is, the sleeve member 110, the support members 120,140, and the pad member 160 all have edge portions defining thru holes (i.e., holes entirely free from obstructions), and which have a perimeter greater than a corresponding perimeter of the post member 204 (e.g., without limitation, greater than 14 inches, or four sides each having a length of 3.5 inches). See, for example, a rectangular-shaped edge portion 161 (FIG. 4) of the pad member 160 that has a length substantially the same as the perimeter of the sleeve member 110. Additionally, as the mailbox 202 includes the same mounting assembly 100 as the mailbox 2, it will be appreciated that advantages associated with adjustability to vary the elevation of the enclosure member likewise apply to the mailbox 202.

For example and without limitation, it will be appreciated that in the example of FIG. 7, the end portion 112 (FIG. 4) of the sleeve member 110 is coupled to the middle portion 126 such that the first support member 120 has a first elevation with respect to the pad member 160. In the example of FIG. 8, the end portion 112 of the sleeve member 110 is coupled to the first end portion 122 such that the first support member has a second, different elevation with respect to the pad member 160. It will be appreciated that the second end portion 114 (FIG. 4) of the sleeve member 110 likewise has a first elevation and a second elevation with respect to the pad member 160, in the respective examples of FIGS. 7 and 8. Furthermore, in comparing FIG. 7 to FIG. 8, the second support member 120 has been rotated 90 degrees with respect to the first support member 140. This might happen, for example, when the mailbox 202 is mounted in the ground and the support member 120 is removed, rotated 90 degrees, and then re-installed on the sleeve member 110. Additionally, this is achievable by virtue of the end portion 124 being square-shaped. In this manner, the mounting assembly 100 advantageously accommodates enclosure members that are relatively wide as well as those that are relatively narrow. For example and without limitation, relatively narrow enclosure members can be oriented generally perpendicular to the road, and rotation of either one of the support members 120,140 allows relatively wide enclosure members to be oriented generally parallel to the road.

Referring to FIG. 9, the sleeve member 110 has a third rectangular-shaped perimeter having a length less than the lengths of the perimeters of the end portions 122, 124. Accordingly, as seen, the sleeve member 110 is able to be received between the guide rail portions 132, 134, which also allows the post member 204 to be easily inserted into the sleeve member 110. Thus, the mounting assembly 100 provides an alternative mounting mechanism for homeowners who already have an existing post member. Prior art mounting assemblies (not shown) which include internal structures and pad members that are devoid of thru holes, by way of contrast, provide no mechanism by which a standard post member could be accommodated. That is, the structure of such mounting assemblies (not shown) necessitates that they be mounted only to pads (e.g., concrete pads) by virtue of their lack of openings through which a standard post member could be inserted.

As a result, homeowners who already have standard post members (i.e., the post member 204) are advantageously able to also enjoy the benefits of the mounting assembly 100 (e.g., without limitation, satisfying height requirements of the United States Postal Service and/or accommodating desired heights of different homeowners). Additionally, when the mounting assembly 100 is coupled to the post member 204, the pad member 160 advantageously provides a barrier between weeds and/or shrubs, and the upper portions of the mounting assembly 100, thereby allowing the more decorative components (i.e., the sleeve member 110 and the support members 120, 140) of the mounting assembly 100 to be visible.

In view of the foregoing, it will be appreciated that the same single mailbox mounting assembly 100 can be used to mount the mailboxes 2,202 in two different ways, depending on the needs and desires of the installer. No additional parts or modifications are required. Rather, the installer can select the appropriate installation method (i.e., concrete pad or sliding over an existing post). Thus, a method of mounting a mailbox includes the steps of providing the mounting assembly 100, and selecting one of a) mounting the mounting assembly 100 over a post member 204; and b) mounting the mounting assembly 100 on a concrete pad 4.

Accordingly, it will be appreciated that the disclosed concept provides for an improved (e.g., without limitation, more versatile, able to be adjusted) mailbox 2,202 and mounting assembly 100 therefor, in which the mounting assembly 100 is able to be mounted to a concrete pad 4, and also able to receive a post member 204. That is, installers have the option of using the same mounting assembly 100 to mount either to the concrete pad 4 or the post member 204. That is, it is not necessary to mount the mounting assembly 100 to both the concrete pad 4 and the post member 204. Additionally, the mounting assembly provides a novel mechanism to adjust an elevation of an enclosure member 6,206 with respect to the ground.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A mounting assembly for a mailbox, said mailbox comprising an enclosure member, said mounting assembly comprising:

a sleeve member;

a first support member coupled to said sleeve member and structured to be coupled to said enclosure member;

a second support member coupled to said sleeve member; and a pad member coupled to said second support member, wherein said mounting assembly has an axis extending through an opening in each of said sleeve member, said first support member, said second support member, and said pad member.

2. The mounting assembly of claim 1 wherein said sleeve member comprises a first end portion and a second end portion disposed opposite and distal the first end portion; wherein said first support member comprises a first end portion, a second end portion, and a middle portion extending therebetween; wherein said first support member has a FIRST elevation with respect to said pad member and a SECOND elevation with respect to said pad member; wherein the FIRST elevation corresponds to the first end portion of said sleeve member being coupled to the first end portion of said first support member; and wherein the SECOND elevation corresponds to the first end portion of said sleeve member being coupled to the middle portion of said first support member.

3. The mounting assembly of claim 2 wherein said second support member comprises a first end portion, a second end portion, and a middle portion extending therebetween; wherein said sleeve member has a THIRD elevation with respect to said pad member and a FOURTH elevation with respect to said pad member; wherein the THIRD elevation corresponds to the second end portion of said sleeve member being coupled to the first end portion of said second support member; and wherein the FOURTH elevation corresponds to the second end portion of said sleeve member being coupled to the middle portion of said second support member.

4. The mounting assembly of claim 1 wherein at least one of said first support member and said second support member comprises a body having a first side portion, a second side portion disposed opposite said first side portion, and a guide rail portion extending from said first side portion toward said second side portion.

5. The mounting assembly of claim 4 wherein said at least one of said first support member and said second support member further comprises an additional guide rail portion extending from said second side portion toward said first side portion; and wherein said additional guide rail portion is disposed parallel to said guide rail portion.

6. The mounting assembly of claim 5 wherein said sleeve member engages each of said guide rail portion and said additional guide rail portion and is disposed therebetween.

7. The mounting assembly of claim 6 wherein said at least one of said first support member and said second support member is each of said first support member and said second support member.

8. The mounting assembly of claim 1 wherein said sleeve member, said first support member, said second support member, and said pad member are devoid of obstructions so as to slide over and mount on a post member.

9. The mounting assembly of claim 1 wherein at least one of said first support member and said second support member has a first end portion and a second end portion disposed opposite and distal the first end portion; wherein the first end portion has first rectangular-shaped perimeter having a first length; and wherein the second end portion has a second rectangular-shaped perimeter having a second length less than the first length.

10. The mounting assembly of claim 9 wherein said sleeve member has a third rectangular-shaped perimeter having a third length less than the second length.

11. The mounting assembly of claim 10 wherein said pad member has a rectangular-shaped edge portion defining said pad opening; and wherein said edge portion has a fourth length generally the same as the third length.

12. The mounting assembly of claim 1 wherein said pad member comprises a first planar portion and a second planar portion spaced from and generally coplanar with said first planar portion.

13. The mounting assembly of claim 1 wherein said first support member has a first footprint; and wherein said second support member has a second footprint the same as said first footprint.

14. A mailbox comprising:

an enclosure member; and a mounting assembly comprising:

a sleeve member, a first support member coupled to said sleeve member and said enclosure member, a second support member coupled to said sleeve member, and a pad member coupled to said second support member, wherein said mounting assembly has an axis extending through an opening in each of said sleeve member, said first support member, said second support member, and said pad member.

15. The mailbox of claim 14 further comprising a concrete pad coupled to said pad member.

16. The mailbox of claim 15 wherein said pad member comprises a first planar portion and a second planar portion spaced from and generally coplanar with said first planar portion; and wherein said first planar portion and said second planar portion are each coupled to said concrete pad.

17. The mailbox of claim 14 further comprising a post member extending through said pad member and said second support member; and wherein said post member at least partially extends through said sleeve member and said first support member.

18. The mailbox of claim 14 wherein at least one of said first support member and said second support member comprises a body having a first side portion, a second side portion disposed opposite said first side portion, and a guide rail portion extending from said first side portion toward said second side portion.

19. The mailbox of claim 18 wherein said at least one of said first support member and said second support member further comprises an additional guide rail portion extending from said second side portion toward said first side portion; wherein said additional guide rail portion is disposed parallel to said guide rail portion; and wherein said sleeve member engages each of said guide rail portion and said additional guide rail portion and is disposed therebetween.

20. A method of mounting a mailbox, said mailbox comprising an enclosure member, the method comprising the steps of:

providing a mounting assembly comprising a sleeve member, a first support member coupled to said sleeve member and said enclosure member, a second support member coupled to said sleeve member, and a pad member coupled to said second support member, said mounting assembly having an axis extending through an opening in each of said sleeve member, said first support member, said second support member, and said pad member; and selecting one of a) mounting said mounting assembly over a post member; and b) mounting said mounting assembly on a concrete pad.

* * * * *